US006282866B1

(12) United States Patent
Natterer et al.

(10) Patent No.: US 6,282,866 B1
(45) Date of Patent: Sep. 4, 2001

(54) PACKAGING MACHINE

(75) Inventors: Hans Natterer, Legau; Elmar Ehrmann, Grönenbach, both of (DE)

(73) Assignee: Multivac Sepp Haggenmauller GmbH & Co. (DE)

( * ) Notice: Subject to any disclaimer, the term of this patent is extended or adjusted under 35 U.S.C. 154(b) by 0 days.

(21) Appl. No.: 09/526,220

(22) Filed: Mar. 15, 2000

(30) Foreign Application Priority Data

Mar. 19, 1999 (DE) ..... 199 12 491

(51) Int. Cl.[7] ..... B65B 47/02

(52) U.S. Cl. ..... 53/282; 53/559; 198/833; 198/850

(58) Field of Search ..... 53/282, 559; 198/833, 198/850

(56) References Cited

U.S. PATENT DOCUMENTS

| | | | | |
|---|---|---|---|---|
| 802,047 | * | 10/1905 | Krell | 198/833 |
| 1,279,579 | * | 9/1918 | Perkins | 198/833 |
| 3,129,545 | * | 4/1964 | Sloan et al. | 53/112 |
| 3,587,829 | | 6/1971 | Sorensen | 198/131 |
| 3,815,322 | * | 6/1974 | Wyslotsky | 53/112 A |
| 4,229,927 | * | 10/1980 | Day | 53/433 |
| 4,349,997 | * | 9/1982 | Hayasaka et al. | 53/51 |
| 4,366,663 | * | 1/1983 | Grebe | 53/559 |
| 4,537,658 | * | 8/1985 | Albert | 198/850 |
| 4,936,072 | | 6/1990 | Creed et al. | 53/282 |
| 5,009,056 | * | 4/1991 | Porteous | 53/412 |
| 5,509,526 | * | 4/1996 | Bonnet | 198/850 |
| 5,603,203 | * | 2/1997 | Robache | 53/559 |
| 5,921,378 | * | 7/1999 | Bonnet | 198/850 |

FOREIGN PATENT DOCUMENTS

| | | |
|---|---|---|
| 196 45 454 A1 | 3/1998 | (DE) . |
| 0 569 933 A1 | 11/1993 | (EP) . |
| WO 91/03407 | 3/1991 | (WO) . |

* cited by examiner

*Primary Examiner*—Peter Vo
*Assistant Examiner*—Hemant M. Desai
(74) *Attorney, Agent, or Firm*—George W. Neuner; Dike, Bronstei, Roberts, Cushman IP Group of Edwards & Angell LLP

(57) ABSTRACT

A packaging machine comprises a base frame having an input side and an output side as well as a transport path from the input side to the output side. A plurality of tray carriers for holding trays are arranged in succession from the input side to the output side along the transport path. A drive means advances the tray carriers in an advancement plane. Further, feed means are provided for feeding a cover film for covering the filled trays. Successive tray carriers are pivotally interconnected by means of pivoting coupling links. Each tray carrier has engagement elements provided at its forward and rearward side. The drive means is formed as a drive chain with a chain strand trained over chain wheels and the engagement elements engage the chain strand when in a position adjacent thereto. The feed means for the cover film likewise includes laterally guided chain strands which are guided in a plane parallel to the first chain strand along a predetermined length parallel to the first chain strand and at a predetermined distance therefrom. The engagement elements engage the first chain strand along a predetermined length and also the second chain strand along a predetermined length whereby both drive chains are driven by the same drive means.

10 Claims, 5 Drawing Sheets

PACKAGING MACHINE

BACKGROUND OF THE INVENTION

The invention relates to a packaging machine. Specifically, the invention relates to a packaging machine comprising a base frame having an input side and an output side and a transport path from said input side to said output side, a plurality of tray carriers for holding trays, said tray carriers being arranged in succession along said transport path from the input side to the output side, and drive means for advancing the tray carriers in an advancement plane.

U.S. Pat. No. 3,587,829 discloses a line of successive pivotally interconnected tray carriers. Engagement elements are provided at the forward and rearward side of the tray carrier in transport direction and engage a driven star wheel which also serves for deflecting the line of tray carriers. In addition to the engagement elements the line of tray carriers includes further engagement elements arranged laterally of the line and engaged by a sealing device functioning as feeding device for the cover film.

U.S. Pat. No. 4,936,072 discloses a packaging machine comprising a line of pivotally interconnected tray carriers driven by a chain having connecting rods engaging the rearward side of the tray carriers (FIG. 7).

Documents WO 91/03407 and DE-OS-196 45 454 disclose packaging machines wherein the lines of tray carriers are driven by and deflected around star wheels.

OBJECTS OF THE INVENTION

It is an object of the invention to provide an improved packaging apparatus. It is a further object of the invention to provide a packaging apparatus which allows the tray-shaped packages to be firmly and attractively sealed with suitable cover films of various materials for the corresponding product, in particular also as skin packages.

SUMMARY OF THE INVENTION

In order to achieve the above mentioned objects the invention provides a packaging machine comprising a base frame having an input side and an output side and a transport path from the input side to the output side, a plurality of tray carriers for holding trays, said tray carriers being arranged in succession along said transport path and comprising pivoting coupling links for pivotally interconnecting successive tray carriers, engagement elements at the forward side and at the rearward side of said tray carriers, drive means for advancing said tray carriers in an advancement plane, the drive means including a drive chain with a first chain strand trained over chain wheels, the engagement elements engaging the first chain strand when in a position adjacent thereto, and feed means for feeding a cover film for covering the filled trays, the feed means including a second drive chain with a second chain strand trained over chain wheels and coupling the sides of the cover film, the second chain strand being guided in a plane parallel to said first chain strand along a predetermined length parallel to said first chain strand at a predetermined distance therefrom, the engagement elements engaging the first and second chain strand, respectively, along at least a portion of the predetermined length.

BRIEF DESCRIPTION OF THE DRAWINGS

Further advantages, features and objects of the invention will be apparent from the following description of exemplary embodiments with reference to the figures, wherein.

DESCRIPTION OF THE PREFERRED EMBODIMENTS

Figure 1:
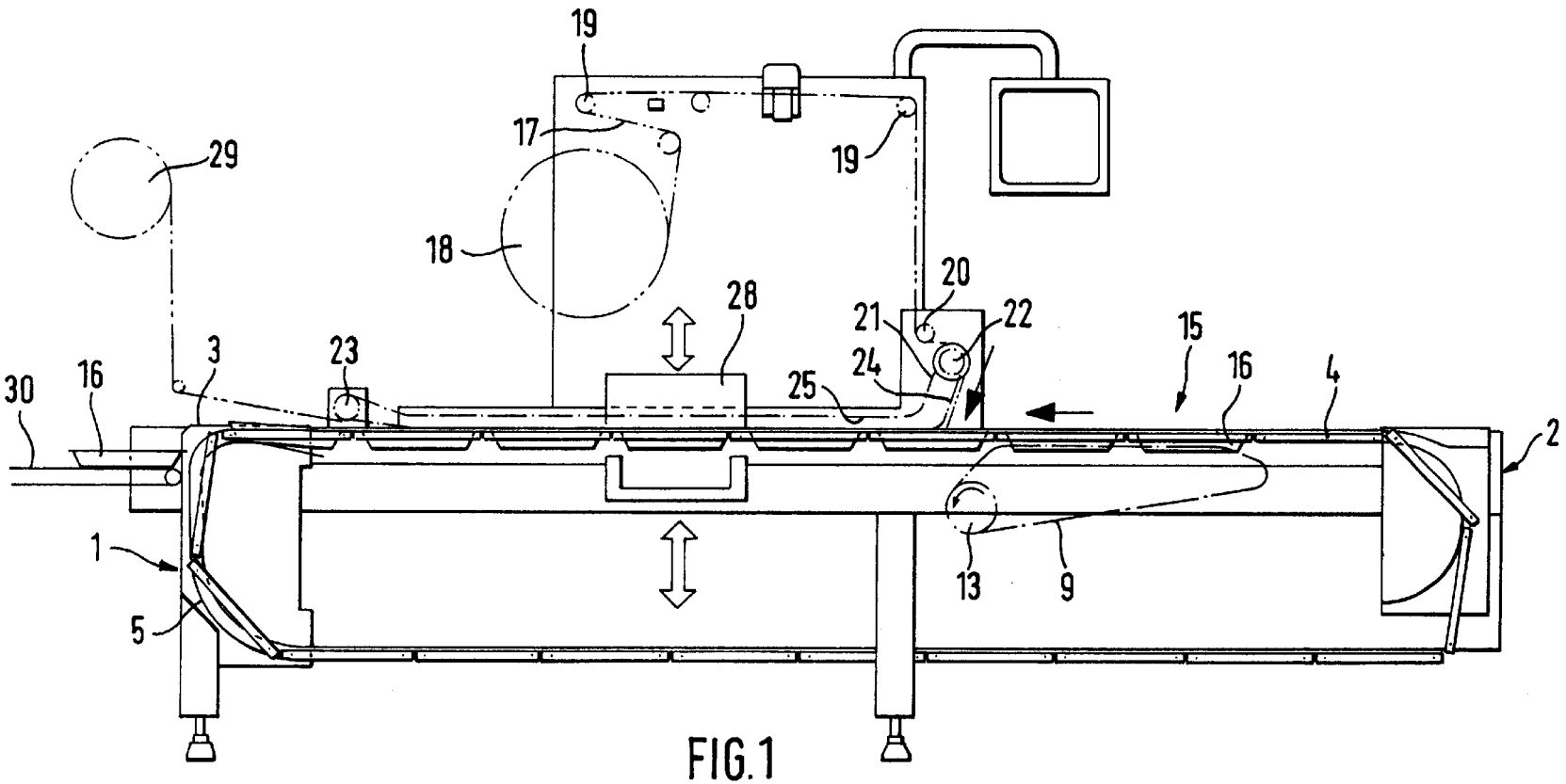
FIG. 1 is a side view of a first embodiment of the packaging machine.
Figure 3:
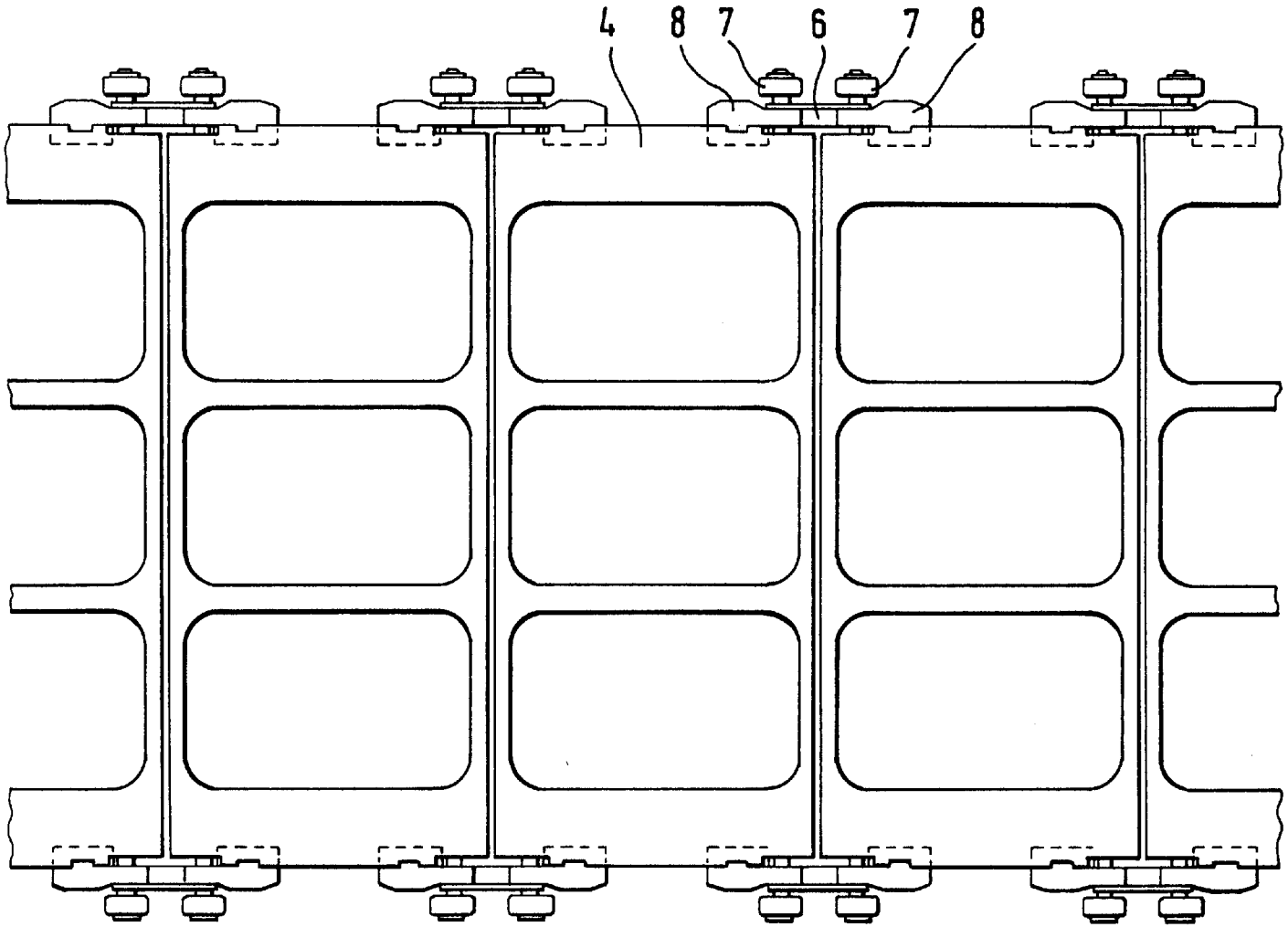
FIG. 3 is a top view of the tray carrier on an enlarged scale.
Figure 4:
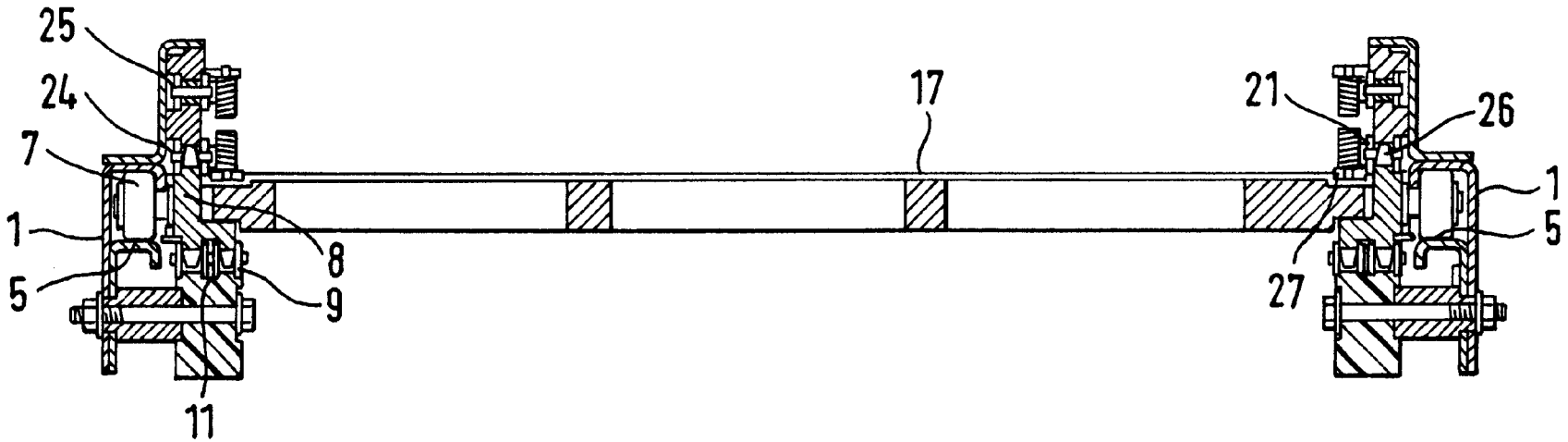
FIG. 4 is a cross section along line IV—IV.

As best shown in FIG. 1 the packaging machine comprises a base frame 1 with an input side 2 and an output side 3. A plurality of tray carriers 4 are conveyed along the base frame from the input side to the output side. The base frame comprises, on each side transversely to or laterally of the advancement or forward feed direction 10, as best shown in FIG. 4, a guide track extending from the input side to the output side and, as best shown in FIG. 1, in a closed path from the output side in the upper region down to lower region of the base frame, therefrom to the input side and from the input side back to the upper region of the base frame. As best shown in FIG. 3 the tray carriers 4 are pivotally inter-connected by means of corresponding coupling links 6. Close to their adjacent ends the coupling links 6 have lateral rollers or wheels 7 for continuously circulating or advancing the plurality of tray carriers through the base frame whereby the tray carriers are interconnected to form a kind of strand and run along the guide tracks through the base frame.

Figure 2:
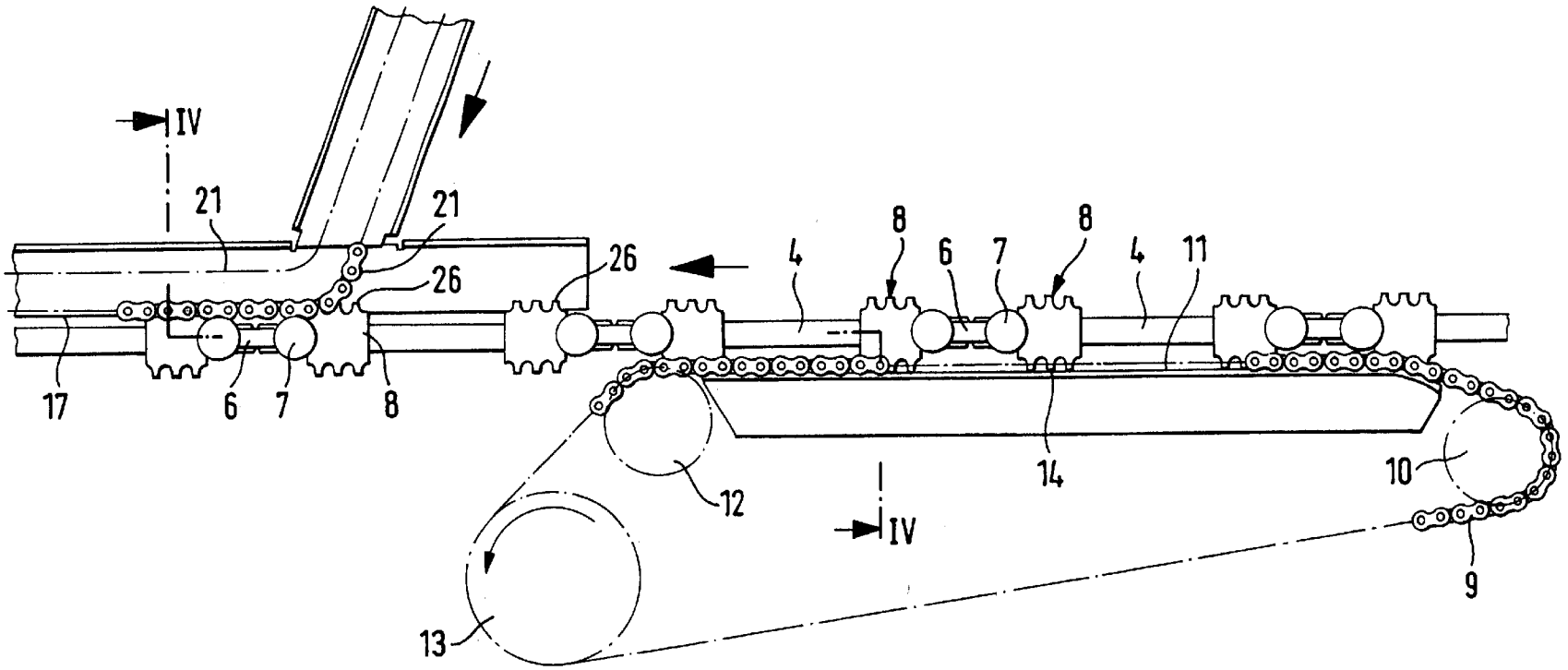
FIG. 2 shows a detail of the machine of FIG. 1 on an enlarged scale.

As best shown in FIG. 2 a respective engagement element 8 is arranged between the tray carriers 4 and the wheels 7 close to each end of the tray carriers.

As best shown in FIG. 2 a drive chain 9 is provided immediately below the engagement elements 8. The drive chain 9 is formed as a circulating chain strand which is deflected, on the input side, by a deflection chain wheel 10 from a lower path to an upper path and therefrom guided along a portion corresponding to a length of at least two tray carriers 4 by a guide track 11 supporting the chain from below and guiding it parallel to the path of the tray carriers. After leaving the guide track the chain is trained over a second deflection chain wheel 12 and a motor driven sprocked wheel 13 back to the chain wheel 10. As best shown in FIG. 2 the engagement elements 8 comprise, on their side facing the drive chain 9, teeth 14 formed to mesh with the drive chain 9 for forward feed. The elevation of the guide track 11 is selected so as to firmly urge the chain onto the lower side of the engagement elements 8 into engagement with the teeth 14.

The above described apparatus transports, after switching on the drive of the sprocked wheel 13, the tray carriers 4 forming an interconnected strand from the input side 2 to the output side 3 on an endless path through the machine and the working stations provided therein.

As best shown in FIG. 1 trays 16 are inserted into the tray carriers 4 at a station 15 close to the input side. The trays are either already filed when inserted or are filled immediately after insertion. At a place which is, in forward feed direction, behind the place of inserting and filling the trays, a cover film 17 is supplied for covering and sealing the trays. The apparatus for supplying the cover film 17 comprises a roll mount 18 receiving an indicated film roll and deflection rollers 19, 20. As best shown in FIG. 1 a conveyor chain path with a conveyor chain 21 is provided above the plane of movement of the tray carriers 4 with the inserted trays from the input side to the output side. The conveyor chain path comprises a first chain wheel 22 at the input side and a second chain wheel 23 at the output side. The conveyor chain 21 is formed as a closed circulating chain strand. As best shown in FIGS. 1 and 2 a slide way is provided between the two chain wheels 22 and 23. The slide way comprises a guide track 24 having an underside along which the chain runs in forward feed direction between the first chain wheel 22 and the second wheel 23. The returning portion of the conveyor chain 21 between the second chain wheel and the first chain wheel is guided on a second guide track. The first guide track 24 is designed so as to guide the conveyor chain 21 closely above the engagement elements 8, as shown in FIG. 2. The engagement elements 8 comprise, on their upper side opposite to the lower teeth 14, corresponding teeth 26 formed to mesh with the conveyor chain 21. The guide track 24 is arranged to urge the conveyor chain 21 towards the engagement elements 8 and therefore into engagement with the teeth 26.

As best shown in FIG. 4 the conveyor chain 21 with the corresponding guide members is symmetrically provided on both sides of the tray carriers to be conveyed.

In conventional manner the conveyor chain 21 comprises clamps 27 on the tray carrier side of the conveyer chain. As usual the clamps 27 are opened by a predetermined angle for receiving the cover film to be conveyed when passing around the first chain wheel 22 whereafter they are closed and firmly grip the cover film 17 on both sides in the manner shown in FIG. 4 to direct the cover film 17 supplied around the deflection roller 20 to a position closely above the trays and to convey the cover film 17 through the stations up to the second chain wheel.

The conveyor chain 21 is positively driven by the engagement of the engagement elements 8 with the chain, as best shown in FIG. 2. Hence, the conveyor chain 21 is always driven when the motor driving the sprocked wheel 13 advances the drive chain 9.

At the output side the clamps are opened in usual manner by rolling onto the second chain wheel 23, thereby releasing the cover film.

Working stations such as a schematically indicated sealing station 28 and a not shown cutting station for cutting the trays after being sealed by the cover film out of the foil web are provided between the position of supplying the cover film and the second chain wheel 23. A roll 29 for winding up the remainders of the cover film web is arranged at the output side.

In operation the cover film 17 is firmly gripped by the conveyor chains 21 arranged on both sides of the film web and passed closely above the trays through the working stations. In those cases in which the product is within the trays the latter are conventionally sealed in the station 28. However, the same machine is also able to seal packages having the product projecting beyond the upper edge of the trays because the cover film is held under tension and thereby urges the product into the trays, whereafter it is sealed. At the output side the sealed trays are ejected from the tray carriers 4 and conveyed to a station for further processing by means of an indicated conveyor belt 30.

Figure 5:
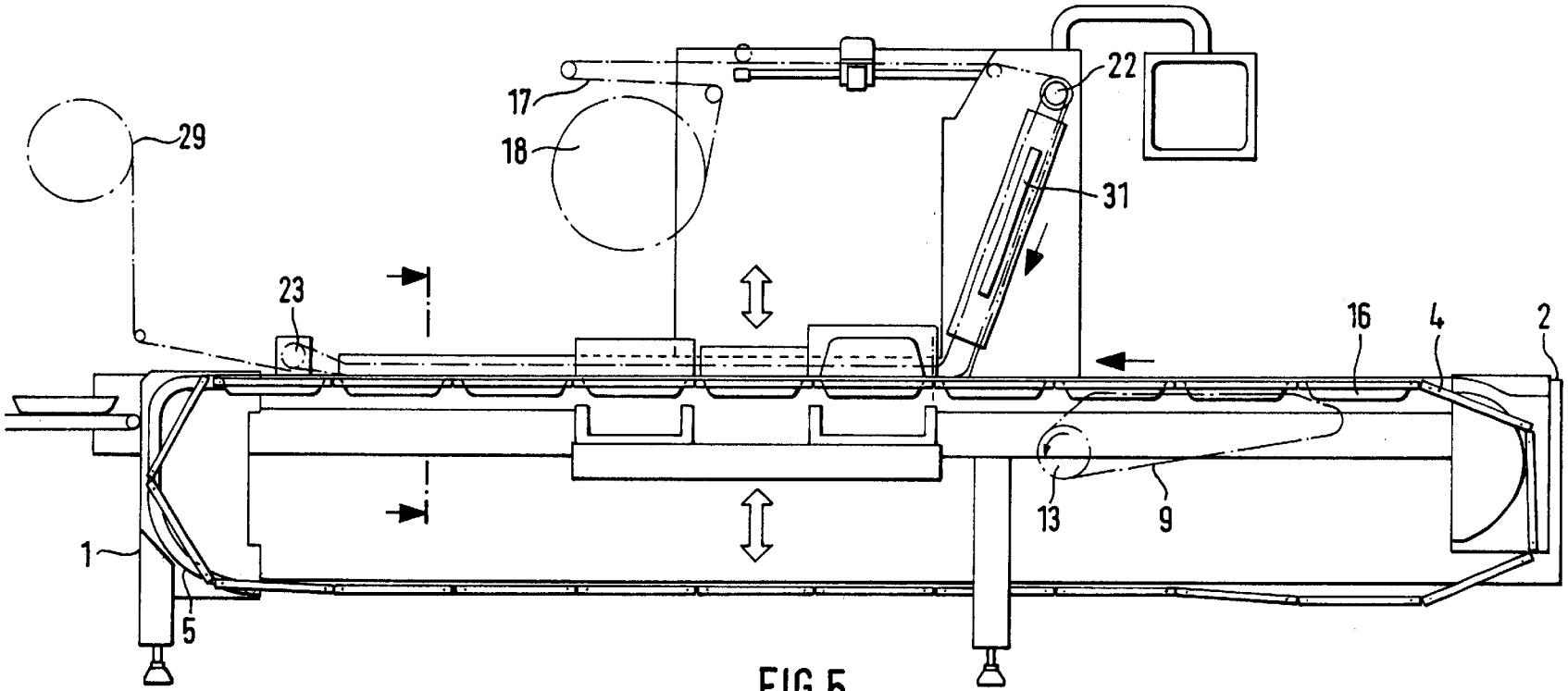
FIG. 5 is a side view of a second embodiment corresponding to FIG. 1.

FIG. 5 shows a modified embodiment in which parts corresponding to the first embodiment have the same reference signs.

The modified embodiment differs from the first embodiment only by having a heating device 31 arranged on the input side ahead of the position of supplying the cover film to the trays to be sealed. The heating device 31 is formed as a plate heater comprising a plurality of bores which are distributed over the surface of the plate heater and connected with an evacuation device. The film passing along the heating device 31 is sucked onto the heating device and heated by conduction to a predetermined temperature in each working phase in which the film is at rest. Thereafter, the evacuation device is switched off and the film is released from the heating device and passed onto the trays in heated state. In case that, in operation, the heated film meets a product projecting beyond the upper edge of the tray, the film stretches at the region of the projecting product so that the product is not deformed by the stretched cover film.

The sealing station can be designed as a skin station to deform, in a conventional manner, the heated cover film so as to hermetically surround the product.

Although the invention has been described with reference to specific example embodiments it is to be understood that it is intended to cover all modifications and equivalents within the spirit and scope of the appended claims.

What is claimed is:

1. A packaging machine comprising a base frame having an input side and an output side, and a transport path from said input side to said output side, a plurality of tray carriers for holding trays, said tray carriers being arranged in succession along said transport path, pivoting coupling links for pivotally interconnecting successive ones of said tray carriers, engagement elements provided at the forward side and at the rearward side of said tray carriers, drive means for advancing said tray carriers in an advancement plane, said drive means including a drive chain with a first chain strand trained over chain wheels, said engagement elements engaging said first chain strand when in a position adjacent thereto, and feed means for feeding a cover film for covering the trays after being filled, said feed means including a second drive chain with a second chain strand trained over chain wheels and gripping the sides of said cover film, said second chain strand being guided in a plane parallel to said first chain strand along a predetermined length parallel to said first chain strand at a predetermined distance therefrom, said engagement elements engaging said first and second chain strand, respectively, along at least a portion of said predetermined length.

2. The packaging machine of claim 1, comprising means for guiding said first chain strand parallel to said advancement plane along a portion which corresponds to at least the distance between two successive ones of said engagement elements.

3. The packaging machine of claim 2, comprising a slide guiding track for guiding said first chain strand, said slide guiding track being provided on the side of said first chain strand opposite to said engagement elements and in the region of said portion.

4. The packaging machine of claim 1, comprising a chain wheel disposed at said output side for deflecting said second chain strand therearound and a sealing station, said second chain strand passing said cover film to a position above the filled trays and to said sealing station.

5. The packaging machine of claim 4, comprising a cutting station located at said output side of said sealing station in advancement direction.

6. The packaging machine of claim 5, comprising a take-up reel at said output side for winding up clippings of said cover film downstream of said cutting station.

7. The packaging machine of claim 4, wherein said sealing station is formed as a sealing end cutting station.

8. The packaging machine of claim 1, comprising a guide track facing said engagement elements for guiding said second chain strand.

9. The packaging machine of claim 1, comprising heating means for heating said cover film to a predetermined temperature, said heating means being provided at a position upstream of a point where the second chain strand meets said engagement elements.

10. The packaging machine of claim 9, wherein said heating means is formed as a large area contact heating device.

* * * * *

UNITED STATES PATENT AND TRADEMARK OFFICE

CERTIFICATE OF CORRECTION

PATENT NO. : 6,282,866 B1
DATED : September 4, 2001
INVENTOR(S) : Hans Natterer, and Elmar Ehrmann It is certified that error appears in the above-identified patent and that said Letters Patent is hereby corrected as shown below:

Title page,
Assignee information should read:
[73] Assignee: Multivac Sepp Haggenmüller GmbH & Co. (DE)

Signed and Sealed this

Nineteenth Day of March, 2002

*Attest:*

*Attesting Officer*

JAMES E. ROGAN
*Director of the United States Patent and Trademark Office*